US008875536B2

(12) United States Patent
Jeong et al.

(10) Patent No.: US 8,875,536 B2
(45) Date of Patent: Nov. 4, 2014

(54) ICE MAKING UNIT AND REFRIGERATOR HAVING THE SAME

(71) Applicant: Samsung Electronics Co., Ltd., Suwon-si (KR)

(72) Inventors: Jin Jeong, Yongin-si (KR); Jae Hoon Lim, Suwon-si (KR); Jae Seung Lee, Suwon-si (KR); Seong Ki Jeong, Incheon (KR); Young Shik Shin, Seongnam-si (KR); Jae Koog An, Gwangju (KR); Chang Hak Lim, Hwaseong-si (KR); Sang Hyun Park, Seongnam-si (KR); Khan Qa Sim, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 14/088,813

(22) Filed: Nov. 25, 2013

(65) Prior Publication Data

US 2014/0083127 A1 Mar. 27, 2014

Related U.S. Application Data

(63) Continuation of application No. 12/926,257, filed on Nov. 4, 2010, now Pat. No. 8,616,018.

(30) Foreign Application Priority Data

Jan. 4, 2010 (KR) ..... 10-2010-0000276

(51) Int. Cl.

| | |
|---|---|
| ***F25C 1/04*** | (2006.01) |
| ***F25D 17/06*** | (2006.01) |
| ***F25C 1/00*** | (2006.01) |
| ***F25C 5/18*** | (2006.01) |

(52) U.S. Cl.

CPC ..... *F25C 1/00* (2013.01); *F25C 2400/10* (2013.01); *F25C 1/04* (2013.01); *F25D 17/062* (2013.01); *F25D 2321/1441* (2013.01); *F25D 2317/061* (2013.01); *F25C 5/182* (2013.01)

USPC ..... 62/356; 62/459

(58) Field of Classification Search

CPC ..... F24C 1/00; F24C 1/04; F24C 5/182; F24C 2400/10; F25D 17/062; F25D 2317/061

USPC ..... 62/340, 344, 356, 459, 138, 419

See application file for complete search history.

(56) References Cited

U.S. PATENT DOCUMENTS 2,158,877 A * 5/1939 Limpert et al. ..... 62/518
2,230,905 A * 2/1941 Popky ..... 62/285

(Continued)

FOREIGN PATENT DOCUMENTS

JP 2006-194461 7/2006
KR 10-2008-0061180 7/2008

OTHER PUBLICATIONS

U.S. Office Action issued Jan. 31, 2013 in copending U.S. Appl. No. 12/926,257.

(Continued)

*Primary Examiner* — Mohammad M Ali

(74) *Attorney, Agent, or Firm* — Staas & Halsey LLP

(57) ABSTRACT

A refrigerator includes a body provided with a freezing compartment, a refrigerating compartment and an ice making compartment provided in the refrigerating compartment; an ice making unit including an ice making tray to produce ice in the ice making compartment; an ice storage container to store the ice made by the ice making unit; and a refrigerant pipe protruding from an interior wall of the body to supply cooling energy to the ice making compartment. A drainage duct is disposed between the ice making unit and the ice storage container adapted to prevent water drops from the ice making unit falling into the ice storage container. The drainage duct include at least one fixer configured to push the refrigerant pipe to a lower surface of the ice making tray to contact the refrigerant pipe with the lower surface of the ice making tray.

6 Claims, 14 Drawing Sheets

(56) References Cited

U.S. PATENT DOCUMENTS

| | | | | |
|---|---|---|---|---|
| 4,142,377 | A * | 3/1979 | Fogt | 62/135 |
| 4,174,742 | A | 11/1979 | Murphey | |
| 4,306,423 | A * | 12/1981 | Webb et al. | 62/353 |
| 4,459,826 | A | 7/1984 | Hirano et al. | |
| 5,025,637 | A | 6/1991 | Hara | |
| 5,253,487 | A * | 10/1993 | Oike | 62/353 |
| 5,425,243 | A * | 6/1995 | Sanuki et al. | 62/138 |
| 5,440,892 | A | 8/1995 | Tatematsu et al. | |
| 6,952,937 | B2 | 10/2005 | Choi et al. | |
| 7,036,334 | B2 * | 5/2006 | Ko et al. | 62/441 |
| 7,654,105 | B2 | 2/2010 | Lee et al. | |
| 7,673,474 | B2 | 3/2010 | Athanasiou | |
| 7,703,298 | B2 | 4/2010 | Lee et al. | |
| 2005/0016202 | A1 * | 1/2005 | Ko et al. | 62/441 |
| 2005/0126202 | A1 | 6/2005 | Shoukyuu et al. | |
| 2005/0160756 | A1 | 7/2005 | Lee et al. | |
| 2005/0235665 | A1 * | 10/2005 | Kim et al. | 62/135 |
| 2006/0213214 | A1 | 9/2006 | Choi | |
| 2006/0260347 | A1 | 11/2006 | Coulter et al. | |
| 2006/0277928 | A1 | 12/2006 | McDougal et al. | |
| 2007/0068188 | A1 | 3/2007 | Newland et al. | |
| 2008/0034780 | A1 | 2/2008 | Lim et al. | |
| 2008/0104991 | A1 | 5/2008 | Hoehne et al. | |
| 2008/0148761 | A1 | 6/2008 | Venkatakrishnan et al. | |
| 2008/0156000 | A1 | 7/2008 | Shin et al. | |
| 2008/0156025 | A1 * | 7/2008 | Shin et al. | 62/349 |
| 2008/0156026 | A1 | 7/2008 | Shin et al. | |
| 2008/0223069 | A1 | 9/2008 | Hsu | |
| 2008/0264082 | A1 | 10/2008 | Tikhonov et al. | |
| 2008/0295539 | A1 | 12/2008 | An et al. | |
| 2010/0000249 | A1 | 1/2010 | Kim et al. | |
| 2010/0031675 | A1 | 2/2010 | Kim et al. | |

OTHER PUBLICATIONS

U.S. Office Action issued Jun. 20, 2013 in copending U.S. Appl. No. 12/926,257.

U.S. Notice of Allowance issued Aug. 26, 2013 in copending U.S. Appl. No. 12/926,257.

U.S. Appl. No. 12/926,257, filed Nov. 4, 2013, Jin Jeong, Samsung Electronics Co., Ltd.

Extended European Search Report mailed Nov. 25, 2013 in corresponding European Application No. 10191370.5.

Chinese Office Action mailed Jan. 30, 2014 in corresponding Chinese Application No. 201010586266.0.

Korean Office Action issued Jul. 25, 2014 in corresponding Korean Patent Application No. 10-2010-0000276.

* cited by examiner

ICE MAKING UNIT AND REFRIGERATOR HAVING THE SAME

CROSS-REFERENCE TO RELATED APPLICATIONS

This application is a continuation of U.S. application Ser. No. 12/926,257, filed on Nov. 4, 2010, which claims the benefit of Korean Patent Application No. 10-2010-0000276 filed on Jan. 4, 2010 in the Korean Intellectual Property Office, the disclosures of which are incorporated herein by reference in their entirety.

BACKGROUND

1. Field

Example embodiments relate to a refrigerator, and, more particularly, to a refrigerator having an improved cooling structure for an ice making compartment.

2. Description of the Related Art

A refrigerator is an apparatus storing food or other articles in a storage compartment in a low temperature state by supplying cold air to the storage compartment using a refrigeration cycle. Such a refrigerator may also be provided with an ice making compartment. In this case, cold air is supplied to the ice making compartment, to make ice.

The refrigeration cycle may include a compressor, a condenser, an expansion valve, and an evaporator. The refrigeration cycle may further include a refrigerant pipe to connect the constituent elements of the refrigeration cycle, and to guide a refrigerant to flow through the constituent elements.

The refrigerator may have various arrangements of constituent elements of the refrigeration cycle, to supply cold air to the ice making compartment. For example, an evaporator may be installed in the ice making compartment or storage compartment. In this case, cold air may be supplied from the evaporator to the ice making compartment in accordance with forced convection thereof after exchanging heat with the evaporator.

The ice making compartment may include with an ice making unit to make ice using cold air supplied through the refrigeration cycle, and an ice storage unit to store the ice made by the ice making unit.

SUMMARY

Therefore, it is an aspect of the example embodiments to provide a refrigerator having an improved cooling structure for an ice making compartment, thereby achieving improved cooling performance of the ice making compartment.

Another aspect of the example embodiments is to provide a refrigerator having an improved cooling structure for an ice making compartment, thereby being capable of achieving easy replacement and repair of an ice making unit.

Another aspect of the example embodiments is to provide a refrigerator having an improved cooling structure for an ice making compartment, thereby achieving improvement in cooling performance of an ice making unit.

The foregoing and/or other aspects are achieved by providing a refrigerator including an ice making compartment, the refrigerator further including an ice making unit arranged in the ice making compartment, to produce ice, and a refrigeration cycle including a refrigerant pipe to supply cooling energy to the ice making compartment, wherein air present in the ice making compartment is cooled while undergoing direct heat exchange with at least one of the ice making unit and the refrigerant pipe.

The refrigerator may further include a fan for the ice making compartment to circulate the air of the ice making compartment and the air comes into contact with at least one of the ice making unit and the refrigerant pipe, thereby promoting the heat exchange.

The ice making unit may include at least one heat-exchanging rib to promote the heat exchange with the air of the ice making compartment.

The ice making unit may include a drainage duct to guide the air of the ice making compartment circulated by the ice making compartment fan to pass through the ice making unit.

The ice making compartment may include at least one suction passage connected to a suction side of the ice making compartment fan, and at least one discharge passage connected to a discharge side of the ice making compartment fan. The ice making unit may be arranged in the at least one discharge passage.

The ice making unit may include a drainage duct to define the at least one discharge passage.

The drainage duct may include an inlet arranged at a leading end of the discharge passage, a first outlet at a trailing end of the discharge passage, and a second outlet at an intermediate portion of the discharge passage.

A part of air sucked through the inlet may be discharged in a longitudinal direction of the drainage duct through the first outlet, and the remaining part of the air may be discharged in a width direction of the drainage duct through the second outlet.

The air discharged in the width direction of the drainage duct through the second outlet may flow in a direction opposite to the suction passage.

The refrigerator may further include at least one of refrigerating and freezing compartment to store articles. The ice making compartment may be insulated from at least one of the refrigerating and freezing compartment.

The refrigerant pipe may include a direct cooling section inserted into the ice making compartment, and coupled to the ice making unit.

The ice making unit may further include an ice making tray, seated on the direct cooling section of the refrigerant pipe. The ice making tray may include at least one heat-exchanging rib to promote the heat exchange with the air in the ice making compartment.

The direct cooling section of the refrigerant pipe may have a U shape, and the at least one heat-exchanging rib may be between U-shaped portions of the direct cooling section of the refrigerant pipe.

The refrigerator may further include at least one fixer to bring the direct cooling section of the refrigerant pipe into close contact with the ice making tray.

The foregoing and/or other aspects are achieved by providing an ice making unit arranged in an ice making compartment, the ice making unit including an ice making tray, and a refrigerant pipe constituting a refrigeration cycle, the refrigerant pipe transferring cooling energy to the ice making tray, wherein at least one of the ice making tray and the refrigerant pipe function as a medium to cause air present in the ice making compartment to undergo heat exchange.

The ice making unit may further include a fan for the ice making compartment to circulate the air of the ice making compartment, thereby promoting the heat exchange of the air with the ice making tray and the refrigerant pipe.

The ice making tray may include at least one heat-exchanging rib to promote the heat exchange with the air in the ice making compartment.

The foregoing and/or other aspects are achieved by providing an ice making unit, comprising an ice making tray, a refrigeration cycle having a cooling pipe in a U-shape attached to the ice making tray, at least one heat exchange rib promoting heat exchange located between the U-shaped cooling pipe, and a fan circulating air and causing the air to come into contact with the cooling pipe.

The cooling pipe may have a direct cooling section.

The ice making unit have also include at least one suction passage on a suction side of the fan and at least one discharge passage on a discharge side of the fan, the ice storage unit located in the at least one discharge passage.

Additional aspects, features, and/or advantages of embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
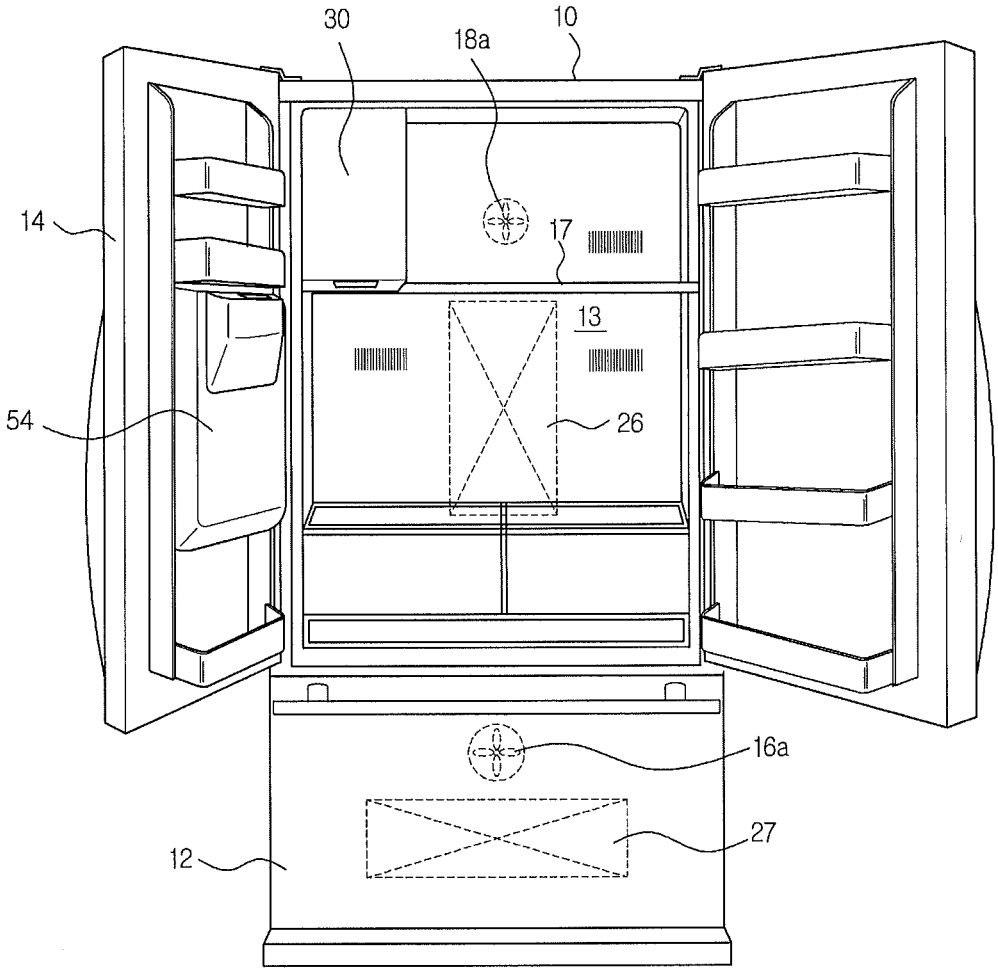
FIG. 1 is a perspective view illustrating a front side of a refrigerator according to example embodiments.

Reference will now be made in detail to embodiments, examples of which are illustrated in the accompanying drawings, wherein like reference numerals refer to like elements throughout. Embodiments are described below to explain the present disclosure by referring to the figures.

Figure 2:
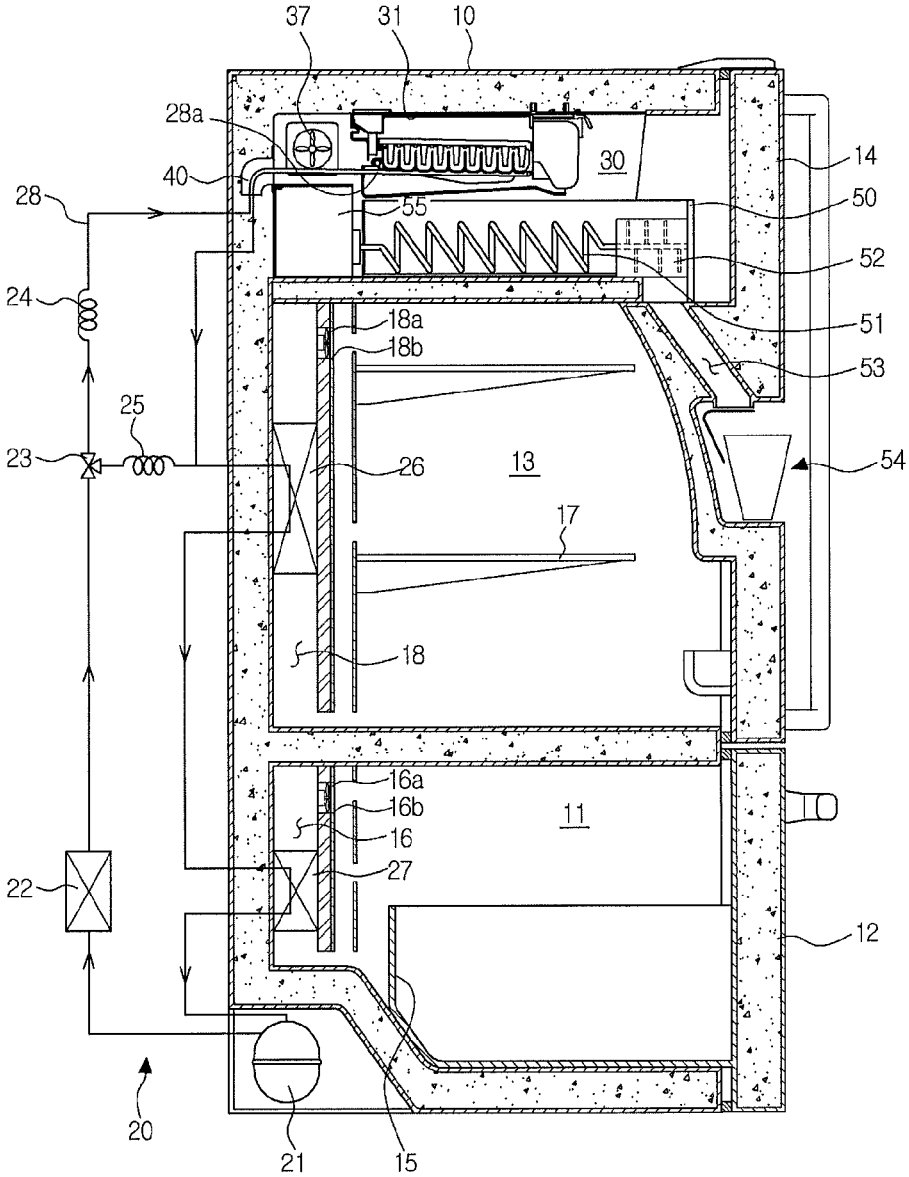
FIG. 2 is a cross-sectional view illustrating the refrigerator shown in FIG. 1.
Figure 3:
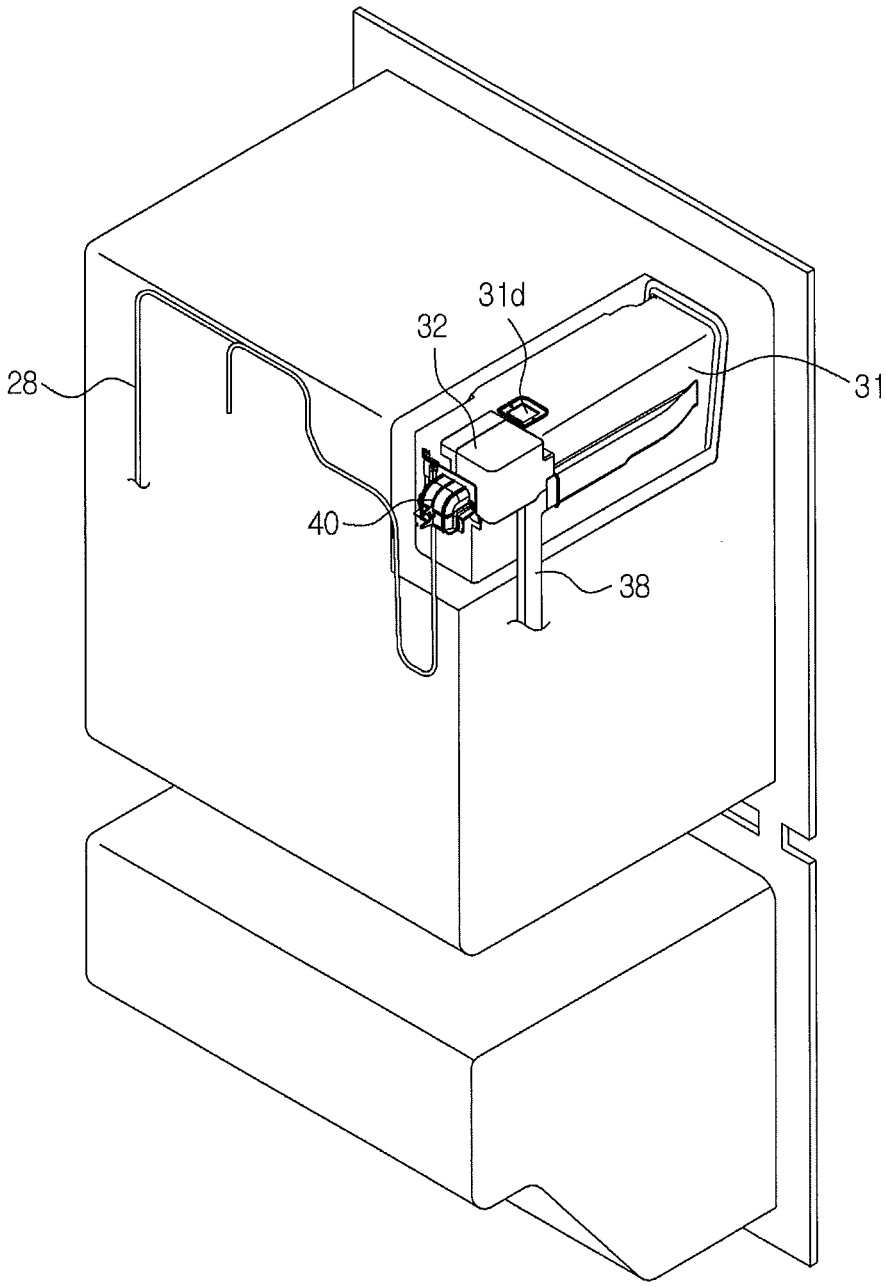
FIG. 3 is a perspective view illustrating a rear side of the refrigerator shown in FIG. 1.

FIG. 1 is a perspective view illustrating a front side of a refrigerator according to example embodiments. FIG. 2 is a cross-sectional view illustrating the refrigerator shown in FIG. 1. FIG. 3 is a perspective view illustrating a rear side of the refrigerator shown in FIG. 1. In particular, FIG. 3 illustrates that an insulating material has not been foamed yet.

As shown in FIGS. 1 to 3, the refrigerator includes a body provided with a freezing compartment 11 and a refrigerating compartment 13, a freezing compartment door 12 to open or close the freezing compartment 11, at least one refrigerating compartment door 14 to open or close the refrigerating compartment 13, and a refrigeration cycle 20 to supply cold air to the freezing compartment 11 and refrigerating compartment 13.

The user may store an article in the freezing compartment 11 after opening the freezing compartment door 12. A freezing box 15 may be installed in the freezing compartment 11. In this case, the user may store and freeze articles in the freezing box 15.

A first cold air supply duct 16 may be provided at a rear wall of the freezing compartment 11. In the first cold air supply duct 16, constituent elements of the refrigeration cycle 20, for example, an evaporator 27 for the freezing compartment, a fan 16*a* for the freezing compartment, and a cold air outlet 16*b* for the freezing compartment may be installed. The freezing compartment fan 16*a* may supply cold air, which has undergone heat exchange with the freezing compartment evaporator 27, to the freezing compartment 11 through the freezing compartment cold air outlet 16*b*.

The user may store articles in the refrigerating compartment 13 after opening the refrigerating compartment door 14. A plurality of racks 17 may be installed in the refrigerating compartment 13. In this case, the user may place articles on the racks 17, in order to store and refrigerate the articles.

A second cold air supply duct 18 may be provided at a rear wall of the refrigerating compartment 13. In the second cold air supply duct 18, constituent elements of the refrigeration cycle 20, for example, an evaporator 26 for the refrigerating compartment, a fan 18*a* for the refrigerating compartment, and a cold air outlet 18*b* for the refrigerating compartment, may be installed. The refrigerating compartment fan 18*a* may supply cold air, which has undergone heat exchange with the refrigerating compartment evaporator 26, to the refrigerating compartment 13 through the refrigerating compartment cold air outlet 18*b*.

An ice making compartment 30 may be provided at one side of the refrigerating compartment 13. The ice making compartment 30 may be partitioned from the refrigerating compartment 13 while being insulated from the refrigerating compartment 13 by an ice making compartment case 31 defining a certain space therein.

In the ice making compartment 30, an ice making unit 60 to make ice and an ice storage container 50 to store the ice made by the ice making unit 60 may be installed. The ice made by the ice making unit 60 may be stored in the ice storage container 50. The ice stored in the ice storage container 50 may be fed to an ice crusher 52 by a feeder 51. Crushed ice produced by the ice crusher 52 may be supplied to a dispenser 54 after passing through an ice discharge duct 53.

At least a portion of a refrigerant pipe 28 included in the refrigeration cycle 20 may be inside of the ice making unit 60. For example, a direct cooling section 28*a* of the refrigerant pipe 28 in the refrigeration cycle 20 may be inserted into the ice making compartment 30. Thus, the direct cooling section 28*a* of the refrigerant pipe 28 may be arranged in the ice making unit 60. The direct cooling section 28*a* of the refrigerant pipe 28 may be in direct contact with the ice making unit 60 and may directly cool the ice making unit 60.

A fan 37 for the ice making compartment may be installed in the ice making compartment 30, to circulate air in the ice making compartment 30. The ice making compartment fan 37 may forcibly blow air from the ice making compartment 30 to the direct cooling section 28*a* of the refrigerant pipe 28 or ice making unit 60 and the air may exchange heat with the direct cooling section 28*a* of the refrigerant pipe 28 or ice making unit 60, and be cooled.

The refrigeration cycle 20 may include a compressor 21, a condenser 22, a first expansion valve 24, a second expansion valve 25, and an evaporator 27 for the freezing compartment, in addition to the refrigerating compartment evaporator 26 and refrigerant pipe 28.

The refrigerant pipe 28 may connect the compressor 21, condenser 22, first expansion valve 24, second expansion valve 25, refrigerating compartment evaporator 26, and freezing compartment evaporator 27. The refrigerant, which flows through the refrigerant pipe 28, may be supplied to the refrigerating compartment evaporator 26 and freezing compartment evaporator 27, after emerging from the compressor 21 and then passing through the condenser 22 and second expansion valve 25. In the refrigerating compartment evaporator 26, the refrigerant exchanges heat with air present in the refrigerating compartment 13, thereby cooling the air of the refrigerating compartment 13. On the other hand, the refrigerant supplied to the freezing compartment evaporator 27 exchanges heat with air present in the freezing compartment 11, thereby cooling the air of the freezing compartment 11. The refrigerant flowing through the refrigerant pipe 28 passes through the direct cooling section 28*a* of the refrigerant pipe 28 via the first expansion valve 24, and then enters the refrigerating compartment evaporator 26 and freezing compartment evaporator 27 in a sequential manner.

A switching valve 23 is provided to control flow of the refrigerant. The refrigerant passes through both the first expansion valve 24 and the second expansion valve 25 or selectively passes through the first expansion valve 24 or second expansion valve 25. FIG. 2 illustrates one example of the refrigeration cycle 20. Of course, the refrigeration cycle 20 is not limited to the examples.

In particular, the refrigerant pipe 28 may be installed at a rear wall of the refrigerator before the insulating material is foamed, so that the refrigerant pipe 28 may be integrated with the rear wall of the refrigerator, as shown in FIG. 3. In this case, the refrigerant pipe 28 may include the direct cooling section 28*a*, which will be inserted into the ice making compartment 30.

Figure 4:
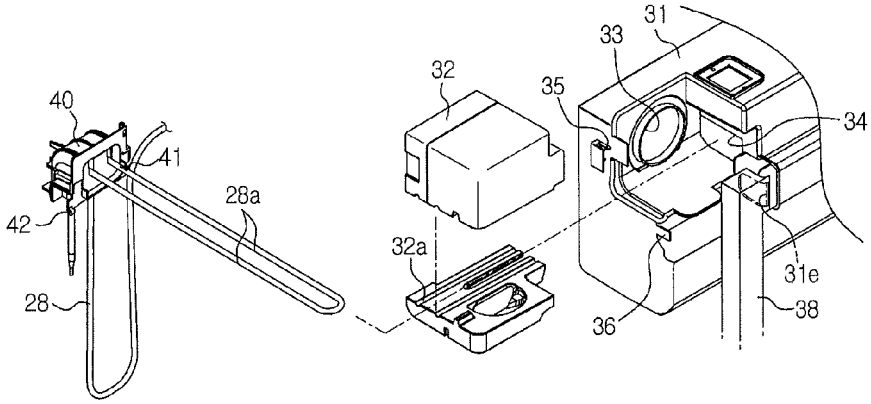
FIG. 4 is a view illustrating a separated state of a refrigerant pipe according to example embodiments.

FIG. 4 is a view illustrating a separated state of the refrigerant pipe according to example embodiments.

As shown in FIGS. 1 to 4, the ice making compartment case 31 may define the ice making compartment 30. The ice making compartment case 31 may partition the ice making compartment 30 from the refrigerating compartment 13 while insulating the ice making compartment 30 from the refrigerating compartment 13.

A guide duct 32 may be installed at the ice making compartment case 31. The guide duct 32 may guide air discharged from a first outlet 33 formed at the ice making compartment case 31 to a second outlet 34 formed at the ice making compartment case 31 and the air discharged from the first outlet 33 may be introduced into the ice making compartment 30 through the second outlet 34.

The guide duct 32 may have a through hole 32*a*, through which the direct cooling section 28*a* of the refrigerant pipe 28 extends. In this case, the direct cooling section 28*a* of the refrigerant pipe 28 extends through the second outlet 34 of the ice making compartment case 31 after passing through the through hole 32*a* of the guide duct 32. Thus, the direct cooling section 28*a* is inserted into the ice making compartment 30. The guide duct 32 may be made of an insulating material because the direct cooling section 28 of the refrigerant pipe 28 extends through the guide duct 32. The guide duct 32, which is made of an insulating material, may prevent formation of frost thereon.

A fixing member 40 may fix the direct cooling section 28 of the refrigerant pipe 28 at a desired position in the ice making compartment 30. The fixing member 40 may be coupled to a terminal end of the direct cooling section 28*a* of the refrigerant pipe 28 to integrate the fixing member 40 with the refrigerant pipe 28. The fixing member 40, which is integrated with the refrigerant pipe 28, may be coupled to the ice making compartment case 31 outside the ice making compartment case 31. The direct cooling section 28*a* of the refrigerant pipe 28 may be inserted into the ice making compartment 30 through the second outlet 34, and held fixed at a desired position in the ice making compartment 30.

The fixing member 40 and ice making compartment case 31 may be coupled to each other by at least one hook coupling structure. In this case, a first hook 41 may be formed at a left side of the fixing member 40. A second hook 42 may be formed at a lower end of a right side of the fixing member 40. A first hook groove 35 may be formed in the ice making compartment case 31 at a position corresponding to the first hook 41. A second hook groove 36 may be formed in the ice making compartment case 31 at a position corresponding to the second hook 42. As the first hook 41 and second hook 42 of the fixing member 40 are coupled to the first hook groove 35 and second hook groove 36 of the ice making compartment case 31, respectively, the fixing member 40 may be fixed to the ice making compartment case 31.

After the coupling of the fixing member 40 to the ice making compartment case 31, an insulating material may be foamed at a rear surface of the refrigerator. During the foaming process for the insulating material, it may be possible to restrict the direct cooling section 28*a* of the refrigerant pipe 28 inserted into the ice making compartment 30 from moving, because the direct cooling section 28*a* is supported by the fixing member 40.

Thus, the direct cooling section 28*a* of the refrigerant pipe 28 may be easily installed in the ice making compartment 30 without using a separate welding process.

Figure 5:
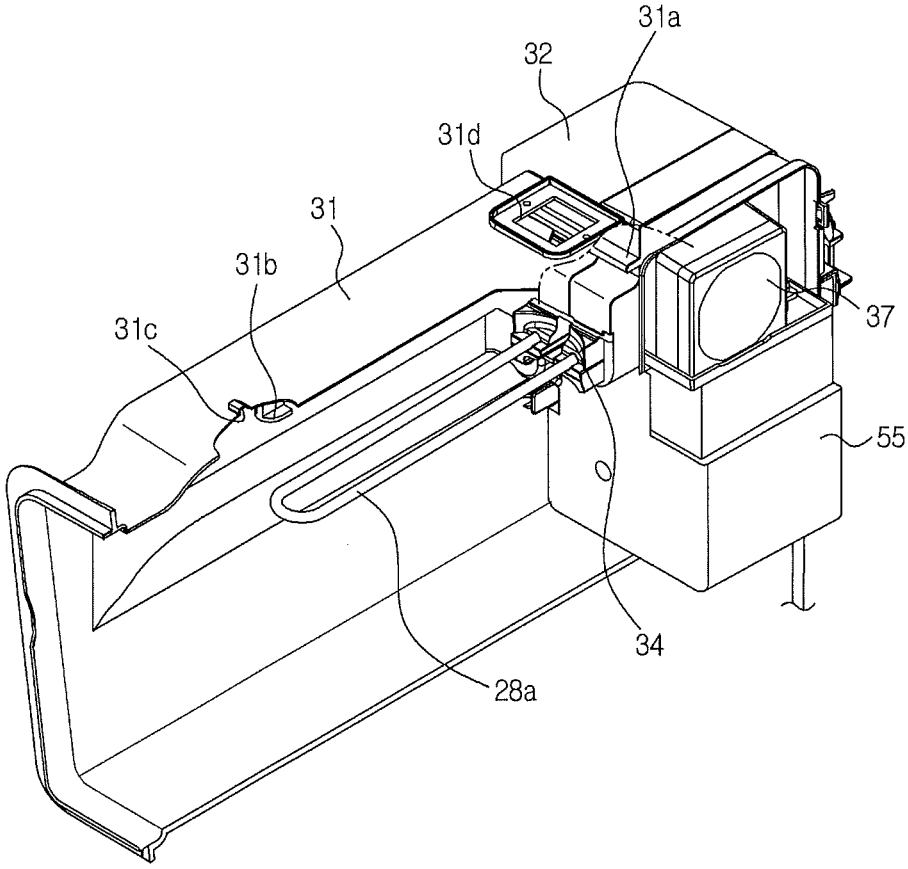
FIG. 5 is a broken perspective view illustrating an interior of an ice making unit which has not been installed according to example embodiments.
Figure 6:
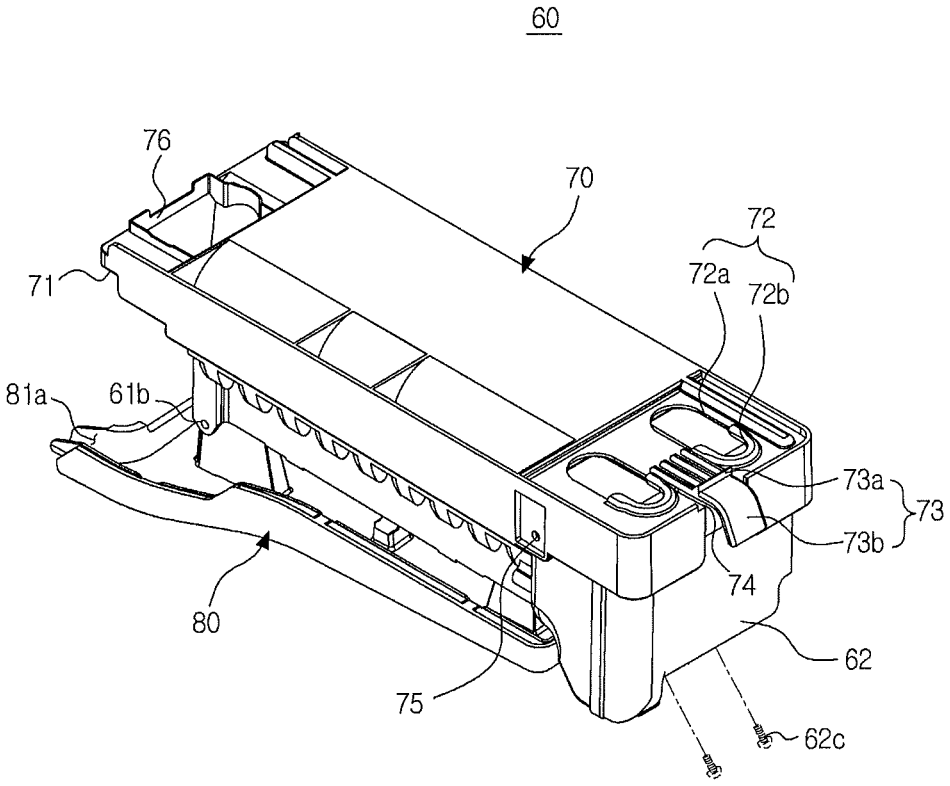
FIG. 6 is a perspective view illustrating a coupled state of the ice making unit according to the illustrated example embodiments.
Figure 7:
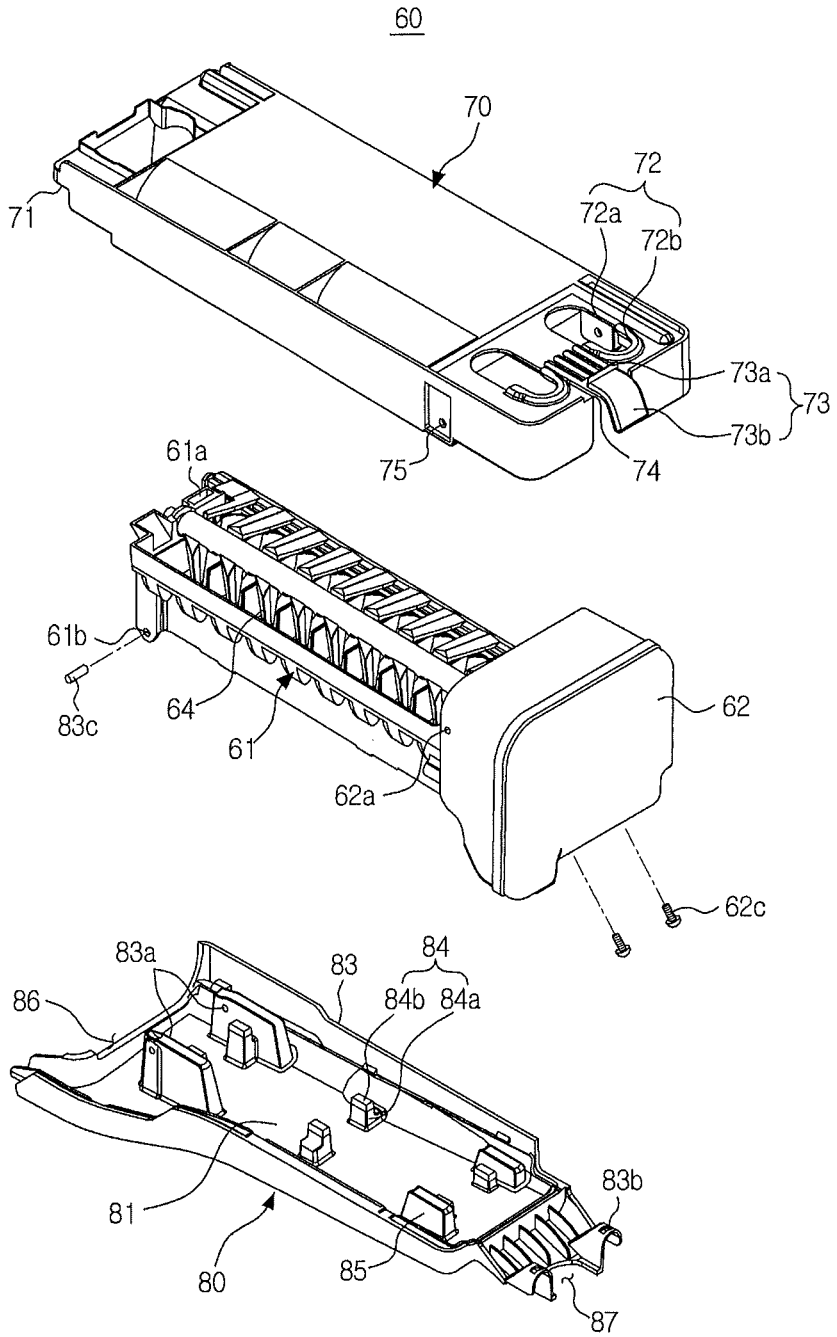
FIG. 7 is an exploded perspective view illustrating an exploded state of the ice making unit according to the illustrated example embodiments.
Figure 8:
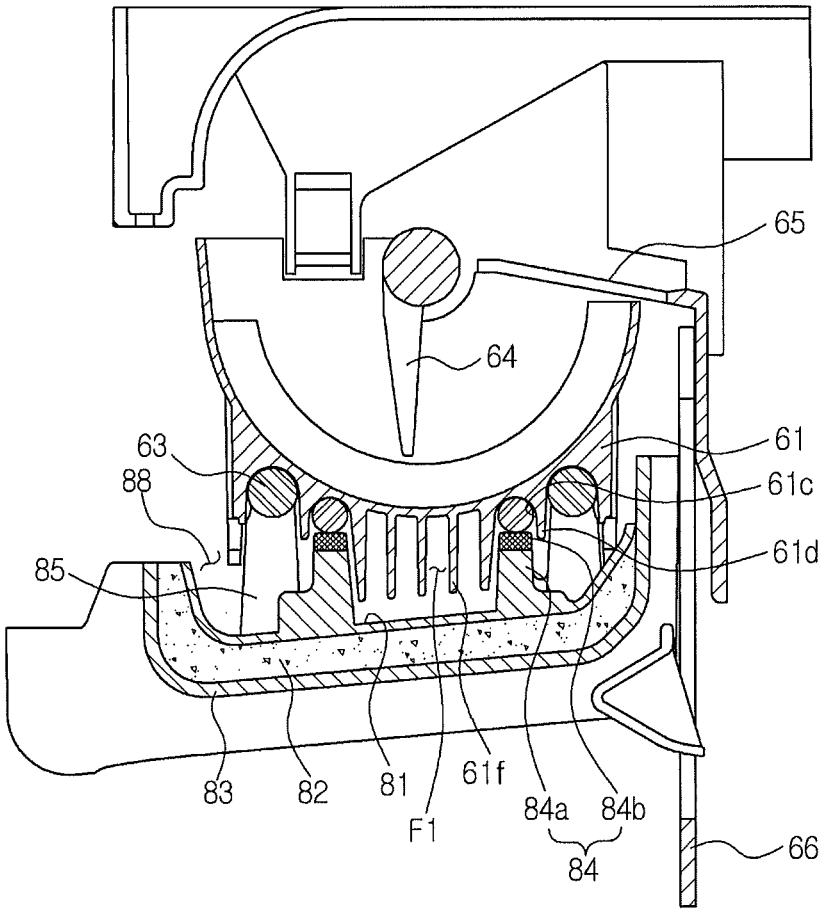
FIG. 8 is a cross-sectional view illustrating the ice making unit according to the illustrated example embodiments.
Figure 9:
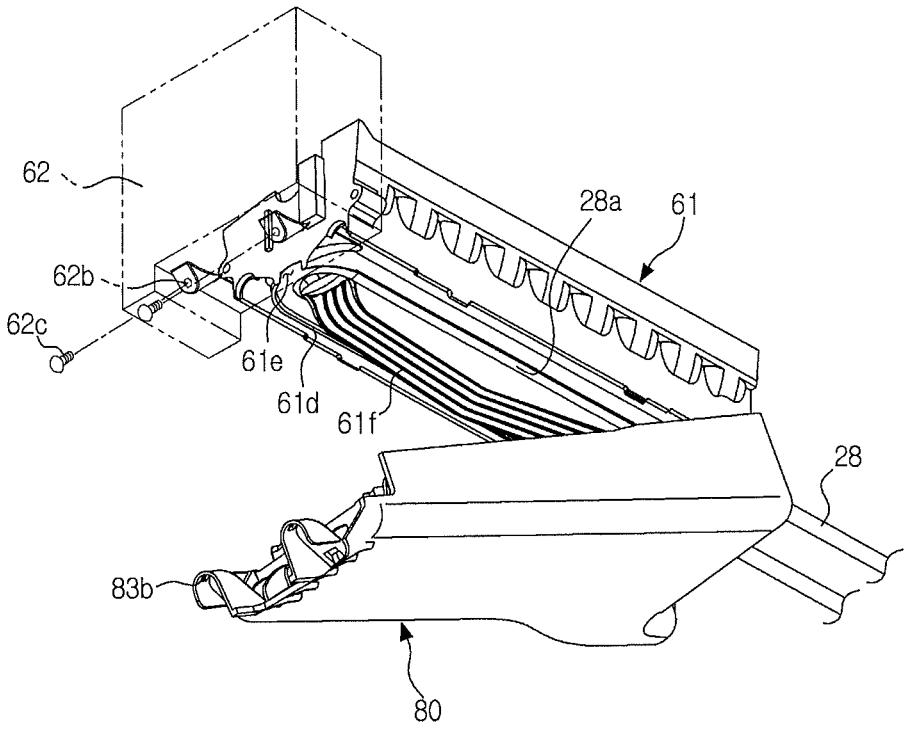
FIG. 9 is a perspective view illustrating a bottom structure of an ice making tray according to example embodiments.
Figure 10:
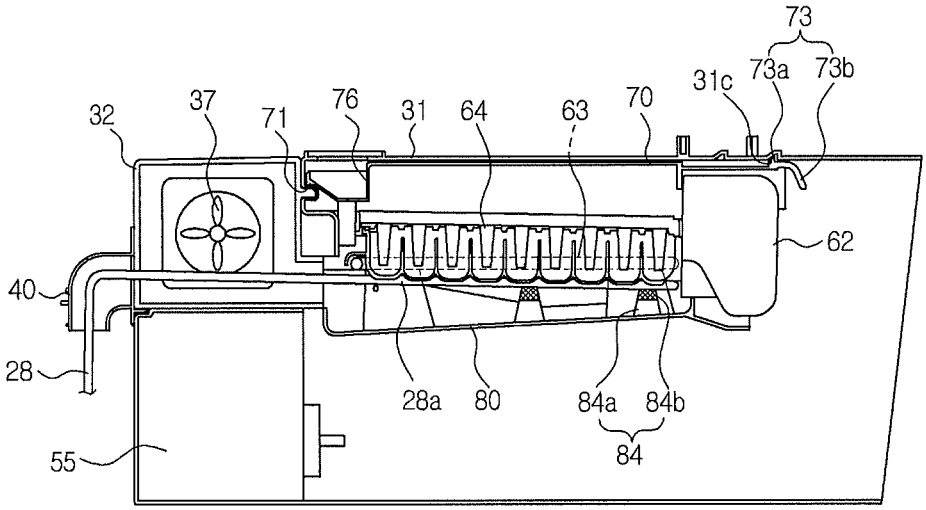
FIG. 10 is a longitudinal sectional view illustrating the ice making unit installed in an ice making compartment according to the illustrated example embodiments.

FIG. 5 is a broken perspective view illustrating an interior of the ice making unit which has not been installed according to example embodiments. FIG. 6 is a perspective view illustrating a coupled state of the ice making unit according to example embodiments. FIG. 7 is an exploded perspective view illustrating an exploded state of the ice making unit according to example embodiments. FIG. 8 is a cross-sectional view illustrating the ice making unit according to example embodiments. FIG. 9 is a perspective view illustrating a bottom structure of an ice making tray according to example embodiments. FIG. 10 is a longitudinal sectional view illustrating the ice making unit installed in the ice making compartment according to example embodiments.

As shown in FIGS. 1 to 10, the direct cooling section 28*a* of the refrigerant pipe 28 may be installed in the ice making compartment 30 and forwardly protrude from a rear wall of the ice making compartment 30. The direct cooling section 28*a* of the refrigerant pipe 28 may be inserted into the ice making compartment 30 through the second outlet 34 of the ice making compartment case 31 while being supported by the fixing member 40 at a desired position in the ice making compartment 30 without being movable.

A driving unit 55 may be installed in the ice making compartment 30, along with the ice making compartment fan 37. The driving unit 55 and ice making compartment fan 37 may be integrated into a single unit may be simultaneously detachably mounted to the ice making compartment 30. Meanwhile, in example embodiments, the driving unit 55 and ice making compartment fan 37 may be separate from each other and may be individually detachably mounted to the ice making compartment 30.

The driving unit 55 may drive the feeder 51 installed in the ice storage container 50. The driving unit 55 may also drive the ice making compartment fan 37. The driving unit 55 may include a motor to drive the feeder 51, and a motor to drive the ice making compartment fan 37.

The ice making compartment fan 37 may circulate air in the ice making compartment 30. The ice making compartment fan 37 may be arranged over the driving unit 55 and may be arranged at a position corresponding to the first outlet 33. The ice making compartment fan 37 sucks air from the ice making compartment 30, and discharges the sucked air into the ice making compartment 30 via the first outlet 33, guide duct 32, and second outlet 34.

In example embodiments, the ice making compartment fan 37 may be coupled to the ice making compartment case 31 at a position corresponding to the first outlet 33 of the ice making compartment case 31. In example embodiments, the ice making compartment fan 37 may be coupled to the ice making unit 60 or ice making compartment case 31 at a position corresponding to the second outlet 34 of the ice making compartment case 31.

The ice making unit 60 may be detachably mounted in the ice making compartment 30. The ice making unit 60 may be coupled to the ice making compartment case 31, and may be fixed at a desired position in the ice making compartment 30. The ice making unit 60 may also be coupled with the direct cooling section 28*a* of the refrigerant pipe 28, and may directly receive cooling energy from the direct cooling section 28*a* of the refrigerant pipe 28.

The ice making unit 60 may include an ice making tray 61, an electric element housing 62, an ice separation heater 63, an ejector 64, a slide 65, and an ice-full sensing lever 66.

The ice making tray 61 may be formed to have a structure capable of containing water supplied to the ice making tray 61. Of course, the ice making tray 61 is not limited in terms of the structure thereof, and may have any structure as the ice making tray 61 is capable of freezing water, to make ice cubes.

The ice separation heater 63 may be installed beneath the ice making tray 61. The ice separation heater 63 may easily separate ice from the ice making tray 61 by heating the ice making tray 61. The ice separation heater 63 may have a U shape extending along an outer periphery of the ice making tray 61.

A pipe seat 61*c* may be provided at a lower surface of the ice making tray 61. The direct cooling section 28*a* of the refrigerant pipe 28 may be seated on the pipe seat 61*c*. The direct cooling section 28*a* of the refrigerant pipe 28 may have a U shape. In accordance with the shape of the direct cooling section 28*a*, the pipe seat 61*c* may also have a U shape. Thus, the direct cooling section 28*a* of the refrigerant pipe 28 may directly cool the ice making tray 61. The cooled tray 61 may freeze water supplied thereto, thereby making ice.

The direct cooling section 28*a* of the refrigerant pipe 28 may be installed to not overlap with the ice separation heater 63. In other words, the direct cooling section 28*a* of the refrigerant pipe 28, which has a U shape, may be interposed between U-shaped portions of the ice separation heater 63. The direct cooling section 28*a* of the refrigerant pipe 28 may be arranged beneath the ice making tray 61 at a position lower than the ice separation heater 63. Thus, it may be possible to prevent heat from the ice separation heater 63 from being directly transferred to the direct cooling section 28*a* of the refrigerant pipe 28. On the other hand, it may also be possible to prevent cooling energy from the direct cooling section 28*a* of the refrigerant pipe 28 from being directly transferred to the ice separation heater 63.

A seat guide 61*d* may be formed along a periphery of the pipe seat 61*c*. The seat guide 61*d* may guide the direct cooling section 28*a* of the refrigerant pipe 28 to be easily seated on the pipe seat 61*c*. Meanwhile, a separation guide groove 61*e* may be formed at the seat guide 61*d*. When the user inserts a tool into the separation guide groove 61*e*, the direct cooling section 28*a* of the refrigerant pipe 28 may be easily separated from the pipe seat 61*c* of the ice making tray 61.

Heat-exchanging ribs 61*f* may be formed at the ice making tray 61. The heat-exchanging ribs 61*f* may be formed at the lower surface of the ice making tray 61. In particular, the heat-exchanging ribs 61*f* may be formed between U-shaped portions of the direct cooling section 28*a* of the refrigerant pipe 28. The heat-exchanging ribs 61*f* may cause cooling energy transferred to the ice making tray 61 to exchange heat with ambient air. That is, the cooling energy transferred from the direct cooling section 28*a* of the refrigerant pipe 28 to the ice making tray 61 may be used to convert water contained in the ice making tray 61 into ice. A part of the cooling energy may be used to cool air present in the ice making compartment 30 via the heat-exchanging ribs 61*f*. Accordingly, when the flow rate of air passing around the heat-exchanging ribs 61*f* increases, the cooling performance of air in the ice making compartment 30 may be increased. However, since a part of the cooling energy is absorbed to the heat-exchanging ribs 61*f*, the water freezing performance of the ice making tray 61 may be reduced.

An electric element housing 62 may be arranged at one end of the ice making tray 61. An electric system to drive the ice separation heater 63 or rotate the ejector 64 may be installed in the electric element housing 62.

The ejector 64 may be arranged over the ice making tray 61. The ejector 64 may upwardly eject ice cubes from the ice making tray 61 while rotating, thereby causing the ice cubes to drop into the slide 65.

The slide 65 may be installed at one side of the ice making tray 61. The slide 65 may have a function to guide the ice cubes to move to the ice storage container 50. The ice cubes may be downwardly moved along the slide 65, and may be contained in the ice storage container 50. In example embodiments, the slide 65 may be installed on a constituent element other than the ice making tray 61.

The ice-full sensing lever 66 may sense whether the ice storage container 50 is full of ice. The ice-full sensing lever 66 may extend toward the ice storage container 50. When the ice-full sensing lever 66 senses an ice-full state, the ice making unit 60 may no longer produce ice.

The ice making unit 60 may further include a supporter 70 and a drainage duct 80.

The supporter 70 may be arranged over the ice making tray 61. The supporter 70 may be coupled, at a front end thereof, to the electric element housing 62 by a screw coupling structure. The supporter 70 may also be coupled, at a rear end thereof, to the ice making tray 61 by a hook coupling structure. The supporter 70 and electric element housing 62 may be coupled by a screw and a first thread hole 75 formed at the supporter 70 and a second thread hole 62*a* formed at the electric element housing 62 are aligned with each other. The supporter 70 and electric element housing 62 may also be coupled as a hook (not shown) formed at the supporter 70 is engaged in a hook groove 61*a* formed at the ice making tray 60. Thus, the supporter 70 may be configured to hold the ice making tray 61. In example embodiments, the supporter 70 may be integral with the ice making tray 61 or electric element housing 62.

The ice making unit 60 may be configured to be detachably coupled to the ice making compartment 30 by the coupling structure for the supporter 70 and ice making compartment case 31. At least one coupling structure may be provided to couple the supporter 70 and ice making compartment case 31. In detail, at least one supporting and coupling structure, at least one hook coupling structure, and at least one locking structure may be provided to couple the supporter 70 and ice making compartment case 31.

The at least one supporting and coupling structure for the supporter 70 and ice making compartment case 31 may include a support 71 provided at a rear side of the supporter 70, and a seat 31*a* provided at a rear side of the ice making compartment case 31. When the ice making unit 60 is inserted into the ice making compartment 30, the support 71 of the supporter 70 may be simply supported by the seat 31*a* of the ice making compartment case 31.

The at least one hook coupling structure for the supporter 70 and ice making compartment case 31 may include a groove 72 provided at a top of the supporter 70, and a hook 31*b* provided at a top of the ice making compartment case 31.

The hook 31*b* may downwardly protrude from the top of the ice making compartment case 31. The groove 72 may include a large diameter portion 72*a* and a small diameter portion 72*b*. The large diameter portion 72*a* may have a size capable of allowing the hook 31*b* to enter the groove 72 through the large diameter portion 72*a*. The small diameter portion 72*b* may have a size capable of preventing the hook 31*b* from being separated from the groove 72 through the small diameter portion 72*b*. Thus, when the ice making unit 60 is inserted into the ice making compartment 30, the hook 31*b* of the ice making compartment case 31 is inserted through the large diameter portion 72*a* of the supporter 70, and is then moved to the small diameter portion 72*b* of the supporter 70. As a result, it may be possible to prevent the hook 31*b* from being separated from the groove 72 through the smaller diameter portion 72*b*.

The at least one locking structure for the supporter 70 and ice making compartment case 31 may include a locking member 73 provided at a front side of the supporter 70, and a locking member receiving portion 31*c* provided at the top of the ice making compartment case 31.

The locking member 73 may be elastically held to the supporter 70 by an elastic cut-out portion 74. The locking member 73 may include a locker 73*a* inserted into the locking member receiving portion 31*c*, and a switch 73*b* elastically deformable while supporting the locker 73*a*. The user or operator may move the locker 73*a* in an upward or downward direction by pressing the switch 73*b*. The locking member receiving portion 31*c* may be formed to be recessed from the top of the ice making compartment case 31. There may be more than one locking member receiving portion 31*c*. When the ice making unit 60 is inserted into the ice making compartment 30, the locking member 73 of the supporter 70 may be engaged in the locking member receiving portion 31*c* of the ice making compartment case 31.

Thus, the ice making unit 60 may be mounted in the ice making compartment 30 while being restricted from moving in forward/rearward and upward/downward directions of the ice making unit 60 by the at least one coupling structure for the supporter 70 and ice making compartment case 31. On the other hand, the user or operator may release the at least one coupling structure for the supporter 70 and ice making compartment case 31, thereby separating the ice making unit 60 from the ice making compartment 30.

Meanwhile, a water supply tank 76 may be formed at the supporter 70. The water supply tank 76 may communicate with a water supply hole 31*d* provided at the ice making compartment case 31 and connected to an external water supply pipe (not shown). Water supplied from an external water supply source may be supplied to the ice making tray 61 via the water supply hole 31*d* and water supply tank 76.

The drainage duct 80 may be arranged beneath the ice making tray 61. The drainage duct 80 may collect water falling from the ice making tray 61 or from the direct cooling section 28*a* of the refrigerant pipe 28, and outwardly drain the collected water from the ice making compartment 30. The drainage duct 80 may also be configured to prevent formation of frost thereon.

At least one pivotal coupling structure may be provided for the drainage duct 80 and ice making tray 61. The at least one pivotal coupling structure for the drainage duct 80 and ice making tray 61 may include a hinge coupler. The hinge coupler may include first hinge coupling portions 83*a* provided at the drainage duct 80, second hinge coupling portions 61*b* provided at the ice making tray 61, and a hinge shaft 83*c* to couple the first hinge coupling portions 83*a* and second hinge coupling portions 61*b*. Accordingly, the drainage duct 80 may be pivotally moved about the hinge shaft 83*c* with respect to the ice making tray 61.

At least one locking structure may also be provided for the drainage duct 80 and electric element housing 62. The at least one locking structure for the drainage duct 80 and electric element housing 62 may include a screw coupler. The screw coupler may include first screw coupling portions 83*b* provided at the drainage duct 80, second screw coupling portions 62*b* provided at the electric element housing 62, and screws 62*c* fastened to the first screw coupling portions 83*b* and second screw coupling portions 62*b*. The screws 62 may be fastened in an oblique direction using a tool, allowing the user or operator to fasten the screws 62 outside the ice making compartment 30.

Thus, it may be possible to support the drainage duct 80 beneath the ice making tray 61 without causing movement of the drainage duct 80, using the at least one locking structure. On the other hand, the user or operator may release the at least one locking structure, thereby pivotally moving the drainage duct 80 to space it apart from the ice making tray 61 by a desired distance.

The drainage duct 80 may include a drainage basin 81, an insulator 82, an anti-frost cover 83, and one or more heater contacts 85.

The drainage basin 81 collects water falling from the ice making tray 61 or refrigerant pipe 28. The drainage basin 81 may be inclined to allow the collected water to flow toward a drainage hole 81*a*. The drainage basin 81 may be made of a material having high thermal conductivity, for example, aluminum. Accordingly, the drainage basin 81 may promote heat transfer from the ice separator heater during a defrosting operation, and ice may be easily thawed and easily drained.

Meanwhile, defrost water drained through the drainage hole 81*a* may be drained outward through a drainage hose 38 connected to the drainage hole 31*e* provided at the ice making compartment case 31.

Frost may easily form on the drainage basin 81, because of the material of the drainage basin 81. In order to prevent such a phenomenon, the anti-frost cover 83 may surround the drainage basin 81. In particular, the insulator 82 is interposed between the drainage basin 81 and the anti-frost cover 83, in order to prevent heat from being transferred between the drainage basin 81 and the anti-frost cover 83. The anti-frost cover 83 may be made of a material having low thermal conductivity, for example, an injection-molded plastic product. In this case, it may be possible to prevent frost from forming on the drainage basin 81 and anti-frost cover 83.

The one or more heater contacts 85 may be provided at the drainage basin 81. The heater contacts 85 may be configured to connect the drainage basin 81 and ice separation heater 63. The heater contacts 85 may be made of a material capable of transferring heat. In this case, the heater contacts 85 may transfer heat from the ice separation heater 63 to the drainage basin 81, thereby preventing frost from forming on the drainage basin 81. The number of heater contacts 85 may be diversely selected in accordance with the amount of heat to be transferred to the drainage basin 81. The heater contacts 85 may be made of a material having high thermal conductivity. The heater contacts 85 may be made of the same material as the drainage basin 81, for example, aluminum.

The drainage duct 80 may further include at least one fixer 84 to fix the direct cooling section 28*a* of the refrigerant pipe 28 to the ice making tray 61. The at least one fixer 84 may bring the direct cooling section 28*a* of the refrigerant pipe 28 into close contact with the pipe seat 61*c* of the ice making tray 61, and the direct cooling section 28*a* may be fixed to the lower surface of the ice making tray 61. Accordingly, the direct cooling section 28*a* of the refrigerant pipe 28 may come into contact with the ice making tray 61, thereby directly cooling the ice making tray 61.

The fixer 84 may include a pressing portion 84*a* and an elastic portion 84*b*.

The pressing portion 84*a* of the fixer 84 may be made of the same material as the direct cooling section 28*a* of the refrigerant pipe 28, for example, copper. If the pressing portion 84*a* of the fixer 84 directly presses the direct cooling section 28*a* of the refrigerant pipe 28, the direct cooling section 28*a* may be damaged.

The elastic portion 84*b* of the fixer 84 may be made of a rubber material. The elastic portion 84*b* is allowed to come into direct contact with the direct cooling section 28*a* of the refrigerant pipe 28. Since the elastic portion 84*b* of the fixer 84 may be deformed when it comes into contact with the direct cooling section 28*a* of the refrigerant pipe 28, it may be possible to prevent the direct cooling section 28*a* from being damaged. Moreover, the elastic portion 84*b*, which is made of a rubber material, exhibits very low thermal conductivity, and it may be possible to prevent cooling energy from the direct cooling section 28*a* of the refrigerant pipe 28 from being transferred to the drainage duct 80. Thus, it may be possible to prevent frost from forming on the drainage duct 80.

The at least one fixer 84 may be integrated with the drainage duct 80. That is, one or more fixers 84 may protrude from the drainage duct 80 toward the ice making tray 61. The fixers 84 may be arranged at opposite sides of the drainage duct 80, respectively. A discharge passage 100 may be formed between the ice making tray 61 and the drainage duct 80. The fixers 84 may be arranged at opposite sides of the discharge passage 100, respectively, in order to minimize flow resistance of air flowing through the discharge passage 100 in the ice making compartment 30. As a result, the amount of air flowing through the discharge passage 100 in the ice making compartment 30 may increase, and the amount of air exchanging heat with the heat-exchanging ribs 61*f* of the ice making tray 61 may be increase. Thus, it may be possible to effectively cool air in the ice making compartment 30.

The heat-exchanging ribs 61*f* may be downwardly protrude and approach the drainage duct 80. The heat-exchanging ribs 61*f* may be arranged between the fixers 84 arranged at opposite sides of the discharge passage 100. Accordingly, the heat-exchanging ribs 61*f* may increase the amount of air exchanging heat in the ice making compartment 30 because they occupy an increased area in the discharge passage 100.

Figure 11:
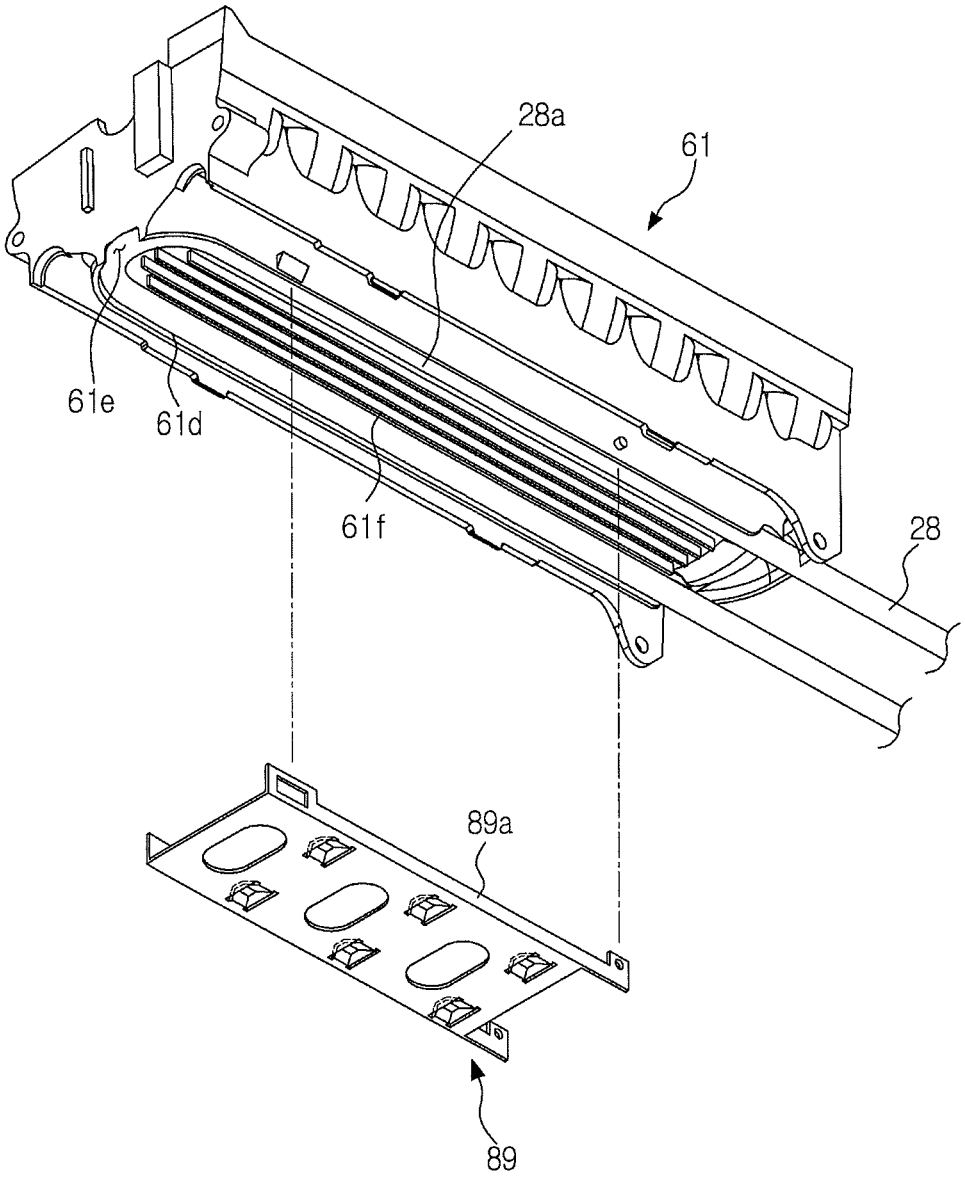
FIG. 11 is an exploded perspective view illustrating an exploded state of an ice making unit according to example embodiments.
Figure 12:
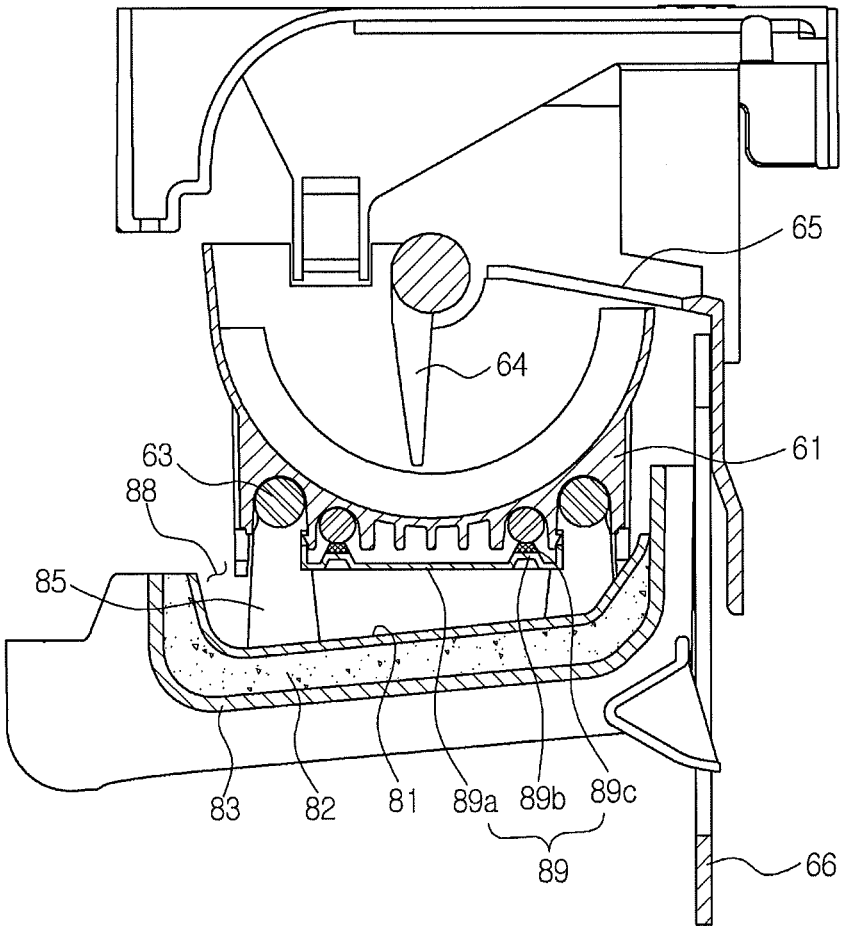
FIG. 12 is a cross-sectional view illustrating the ice making unit shown in FIG. 11.

FIG. 11 is an exploded perspective view illustrating an exploded state of an ice making unit according to example embodiments. FIG. 12 is a cross-sectional view illustrating the ice making unit shown in FIG. 11.

Referring to FIGS. 1 to 12, it may be seen that FIGS. 1 to 10 illustrate the fixer 84, which is integral with the drainage duct 80, whereas FIGS. 11 and 12 illustrate a fixer 89, which is separate from the drainage duct 80. In the following description, configurations shown in FIGS. 11 and 12 will be described to focus on different portions from the configurations discussed with reference to FIGS. 1 to 10.

The fixer 89 may be arranged between the ice making tray 61 and the drainage duct 80. The fixer 89 may fix the direct cooling section 28*a* of the refrigerant pipe 28 to the ice making tray 61.

The fixer 80 may include a fixer body 89*a*, a pressing portion 89*b*, and an elastic portion 89*c*.

The fixer body 89*a* may be coupled to a lower surface of the ice making tray 61. The pressing portion 89*b* may press the direct cooling section 28*a* of the refrigerant pipe 28. The elastic portion 89*c* may be formed at an end of the pressing portion 89*b*. Because the elastic portion 89*c* may deform when it comes into contact with the direct cooling section 28*a* of the refrigerant pipe 28, it may be possible to prevent the direct cooling section 28*a* from being damaged.

Figure 13:
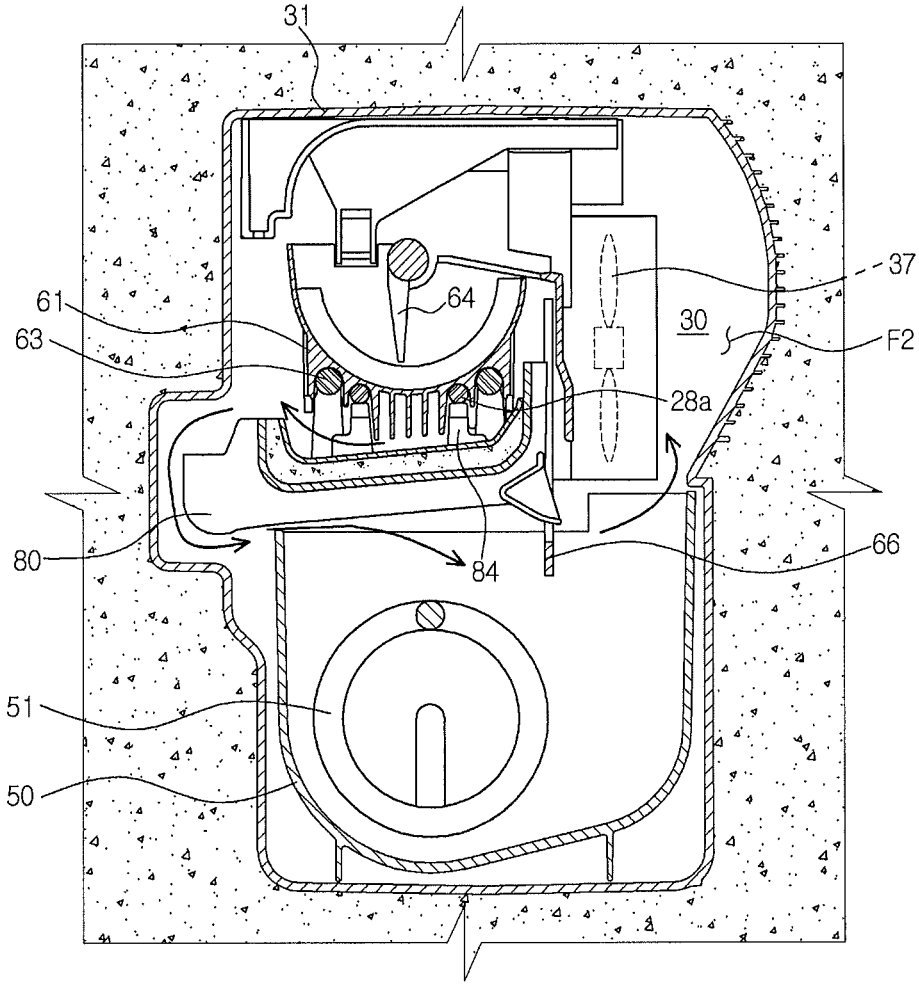
FIG. 13 is a cross-sectional view illustrating a flow of air in the ice making compartment according to example embodiments.
Figure 14:
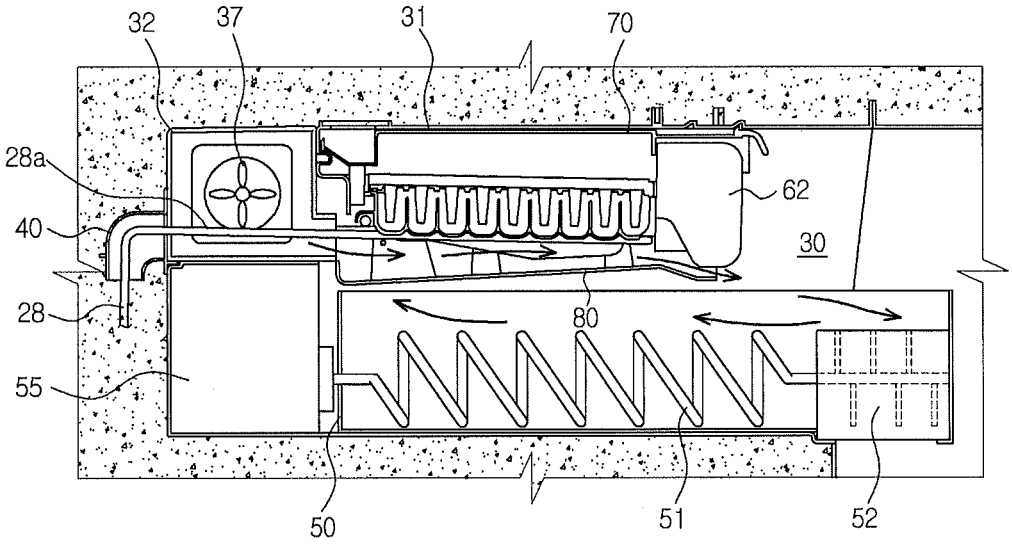
FIG. 14 is a longitudinal sectional view illustrating the air flow in the ice making compartment according to the illustrated example embodiments.

FIG. 13 is a cross-sectional view illustrating a flow of air in the ice making compartment according to example embodiments. FIG. 14 is a longitudinal sectional view illustrating the air flow in the ice making compartment according to the example embodiments.

As shown in FIGS. 1 to 14, the drainage duct 80 is configured to surround the ice making tray 61 to define a certain space between the ice making tray 61 and the drainage duct 80. The space may be used as the discharge passage 100, and air discharged by the ice making compartment fan 37 may flow through. The air present in the ice making compartment 30 may be cooled as it undergoes heat exchange with the heat-exchanging ribs 61*f* of the ice making tray 61 or the direct cooling section 28*a* of the refrigerant pipe 28.

Also, a certain space may be defined between the ice making unit 60 and the ice making compartment case 31. This space may be used as a suction passage 101, and air sucked into the ice making compartment fan 37 may flow through.

The drainage duct 80 may include an inlet 86 to introduce air into the drainage duct 80, and first and second outlets 87 and 88 to outwardly discharge air from the drainage duct 80. The inlet 86 may be provided at a leading end of the discharge passage 100. The first outlet 87 may be provided at a trailing end of the discharge passage 100. The second outlet 88 may be provided at an intermediate portion of the discharge passage 100. Air present in the ice making compartment 30 may be introduced into the drainage duct 89 through the inlet 86. The introduced air may then be discharged through the first outlet 87 while flowing in a longitudinal direction of the drainage duct 80. The air may also be discharged through the second outlet 88 while flowing in a width direction of the drainage duct 80.

The first outlet 87 may be downwardly inclined. Since the drainage duct 80 may be arranged over the ice making compartment 30, it may be possible to move cold air discharged from the first outlet 87 up to the corners of the ice making compartment 30 by installing the first outlet 87 directed forwardly and downwardly. In particular, cold air discharged through the first outlet 87 may be moved to the ice crusher 52, and it may be possible to prevent ice remaining in the ice crusher 52 from thawing.

The second outlet 88 may be formed at an opposite side of the suction passage 101. If cold air discharged from the second outlet 88 is directly introduced into the suction passage 101, it may cool the ice making compartment fan 37, thereby causing formation of frost on the ice making compartment fan 37. Thus, the second outlet 88 is installed at an opposite side of the suction passage 101, to cause the cold air discharged from the second outlet 88 to be introduced into the suction passage 101 after flowing along the drainage duct 80 beneath the drainage duct 80 while cooling the ice making compartment 30. Cold air flows continuously beneath the drainage duct 80, and it may be possible to prevent formation of frost on the drainage duct 80 beneath the drainage duct 80.

Thus, air discharged by the ice making compartment fan 37 may be introduced into the discharge passage 100 through the inlet 86, and may then be cooled in the discharge passage 100 while exchanging heat with the heat-exchanging ribs 61*f* of the ice making tray 61 and the direct cooling section 28*a* of the refrigerant pipe 28. Thereafter, the cooled air may be discharged through the first outlet 87 and second outlet 88, to cool the entire portion of the ice making compartment 30. The air may then be again sucked into the ice making compartment fan 37 via the suction passage 101.

Hereinafter, operation of the refrigerator according to the illustrated example embodiments will be described in detail with reference to the accompanying drawings.

The refrigerant pipe 28 may be arranged at a rear side of the refrigerator before foaming of the insulating material. The fixing member 40 may be installed at a terminal end of the direct cooling section 28*a* of the refrigerant pipe 28. As the fixing member 40 is coupled to the ice making compartment case 31, the direct cooling section 28*a* of the refrigerant pipe 28 is inserted into the ice making compartment 30, and fixed at a desired position in the ice making compartment 30 without being movable.

Thereafter, the insulating material may be foamed to insulate the ice making compartment 30, refrigerating compartment 13, and freezing compartment 11.

Subsequently, the driving unit 55 and ice making compartment fan 37 may be mounted to the ice making compartment 30. The ice making compartment fan 37 may be arranged at the first outlet 33. Air discharged by the ice making compartment fan 37 may be introduced into the ice making compartment 30 after sequentially passing through the first outlet 33, guide duct 32, and second outlet 34.

The ice making unit 60 may then be coupled to the ice making compartment 30.

First, the screws fastened to the drainage duct 80 are unfastened, to secure a certain space between the drainage duct 80 and the ice making tray 61, and to allow the direct cooling section 28*a* of the refrigerant pipe 28 to be inserted into the space.

Simultaneously, the support 71 of the supporter 70 is seated on the seat 31*a* of the ice making compartment case 31. In this state, the groove 72 of the supporter 70 is then engaged with the hook 31*b* of the ice making compartment case 31.

Finally, the ice making unit 60 is fixed to the ice making compartment 30, using the locking structure for the supporter 70 and ice making compartment case 31, namely, engagement of the locking member 73 of the supporter 70 in the locking member receiving portion 31*c* of the ice making compartment case 31.

The direct cooling section 28*a* of the refrigerant pipe 28 may be coupled to the ice making unit 60 by the locking structure for the drainage duct 80 and electric element housing 62, namely, coupling of the first screw coupling portions 83*b* of the drainage duct 80 and second screw coupling portions of the electric element housing 62 by the screws 62*c*. In this case, the fixer 84 may function to fix the direct cooling section 28*a* of the refrigerant pipe 28 to the ice making tray 61.

Thereafter, the ice storage container 50 may be mounted beneath the ice making unit 60.

The ice making compartment fan 37 may then cool the ice making compartment 30 while circulating air in the ice making compartment 30. That is, air discharged by the ice making compartment fan 37 undergoes heat exchange with the heat-exchanging ribs 61*f* of the ice making tray 61 and the direct cooling section 28*a* of the direct cooling section 28*a* of the refrigerant pipe 28, so that the air may be cooled. This cooled air is then discharged from the first and second outlets 87 and 88, thereby cooling the entire portion of the ice making compartment 30. The air is then again sucked into the ice making compartment fan 37 via the suction passage 101.

Meanwhile, the ice making unit 60 may be separable from the ice making compartment 30, for replacement or repair thereof.

The user or operator may press the switch 73*b* of the locking member 73, thereby causing the locker 73*a* of the locking member 73 to be disengaged from the locking member receiving portion 31*c* of the ice making compartment case 31. The user or operator may also release the screw coupling between the drainage duct 80 and the electric element housing 62, thereby separating the fixer 84 from the direct cooling section 28*a* of the refrigerant pipe 28.

The hook 31*b* of the ice making compartment case 31 may be separated from the groove 72 of the supporter 70 through the large diameter portion 72*a* of the groove 72. The support 71 of the supporter 70 may then be separated from the seat 31*a* of the ice making compartment case 31.

The user or operator may then separate the ice making unit 60 from the ice making compartment 30 to outwardly eject the ice making unit 60.

As apparent from the above description, the refrigerator according to the example embodiments may improve cooling performance for the ice making compartment, and may reduce loss of energy occurring during a cooling operation for the ice making compartment. Thus, improvement in the energy efficiency of the refrigerator may be achieved.

It may also be possible to improve the assemblability of the ice making unit, to improve replacement and repair of the ice making unit, and to reduce the assembly process variation of the ice making unit.

Although embodiments have been shown and described, it should be appreciated by those skilled in the art that changes may be made in these embodiments without departing from the principles and spirit of the disclosure, the scope of which is defined in the claims and their equivalents.

What is claimed is:

1. A refrigerator comprising:

a body provided with a freezing compartment, a refrigerating compartment and an ice making compartment provided in the refrigerating compartment;

an ice making unit including an ice making tray to produce ice in the ice making compartment;

an ice storage container to store the ice made by the ice making unit; and a refrigerant pipe protruding from an interior wall of the body to supply cooling energy to the ice making compartment, and a drainage duct is disposed between the ice making unit and the ice storage container adapted to prevent water drops from the ice making unit falling into the ice storage container, wherein the drainage duct include at least one fixer configured to push the refrigerant pipe to a lower surface of the ice making tray to contact the refrigerant pipe with the lower surface of the ice making tray.

2. The refrigerator according to claim 1, wherein the refrigerant pipe comprises a direct cooling section inserted into the ice making compartment, and coupled to the ice making unit, and the at least one fixer brings the direct cooling section of the refrigerant pipe into close contact with the ice making tray such that the direct cooling section can be fixed to the lower surface of the ice making tray.

3. The refrigerator according to claim 1, wherein the at least one fixer is integrated with the drainage duct.

4. The refrigerator according to claim 1, wherein the at least one fixer protrudes from an upper surface of the drainage duct toward the ice making tray.

5. The refrigerator according to claim 2, wherein the at least one fixer includes an elastic portion made of a rubber material to prevent the direct cooling section from being damaged when it comes into contact with the direct cooling section of the refrigerant pipe.

6. The refrigerator according to claim 1, wherein the ice making unit is provided with a refrigerant-pipe-receiving region underneath the ice making tray, which is adapted to mount the refrigerant pipe inside the ice making unit such that thermal conductivity is established between the refrigerant pipe and the ice making tray, when the ice making unit is installed in the ice making compartment.

* * * * *